US006556800B2

(12) United States Patent
Matsuda et al.

(10) Patent No.: US 6,556,800 B2
(45) Date of Patent: Apr. 29, 2003

(54) DEVELOPER SUPPLY CONTAINER AND IMAGE FORMING APPARATUS CAPABLE OF MOUNTING THE CONTAINER THEREON

(75) Inventors: Kenji Matsuda, Shizuoka (JP); Hironobu Isobe, Shizuoka (JP); Akiyoshi Fujita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/883,322

(22) Filed: Jun. 19, 2001

(65) Prior Publication Data

US 2002/0025192 A1 Feb. 28, 2002

(30) Foreign Application Priority Data

Jun. 23, 2000 (JP) ..... 2000-189278

(51) Int. Cl.[7] ..... G03G 15/08
(52) U.S. Cl. ..... 399/258; 399/263
(58) Field of Search ..... 399/258, 262, 399/263, 119, 120, 254, 256; 222/DIG. 1

(56) References Cited

U.S. PATENT DOCUMENTS 5,206,692 A * 4/1993 Ishida et al.
5,655,195 A * 8/1997 Ichikawa et al. ..... 399/263
6,137,978 A * 10/2000 Tsuchiya et al.
6,229,976 B1 * 5/2001 Kimura ..... 399/262
6,324,370 B1 * 11/2001 Isobe et al. ..... 399/258

* cited by examiner

*Primary Examiner*—Robert Beatty

(57) ABSTRACT

A developer supply container is detachably mountable on an image forming apparatus and includes a containing chamber for containing a developer. A first feeding member is provided in the containing chamber and feeds the developer to an outlet of the containing chamber. A feeding chamber communicates with the containing chamber. A second feeding member is provided in the feeding chamber and feeds the developer coming from the containing chamber to an outlet of the container. A partition member partitions the developer supply container into the containing chamber and the feeding chamber. A partitioning area of the partition member is larger than an area of the outlet of the containing chamber. An image forming apparatus includes a developing device and the developer supply container.

11 Claims, 13 Drawing Sheets

DEVELOPER SUPPLY CONTAINER AND IMAGE FORMING APPARATUS CAPABLE OF MOUNTING THE CONTAINER THEREON

BACKGROUND OF THE INVENTION

1. Field of the Invention

The present invention relates to a developer supply container useable in a copying machine, a printer or the like and an image forming apparatus capable of mounting the container thereon.

2. Related Background Art

As an image forming apparatus for forming an image on a recording medium using, for example, an electrophotographic image forming process as a recording technology, a copying machine, a printer (a laser beam printer, an LED printer or the like), a facsimile machine, a wordprocessor and the like have been proposed. Conventionally, fine powder toner has been used as a developer for such an image forming apparatus. When toner is consumed, a developer supply container is used to supply toner to a developing device.

Here, since toner is an extremely fine powder, it is necessary to configure an image forming apparatus such that toner does not scatter during operations for supplying toner. Thus, there is known a process of installing a developer supply container in the apparatus and discharging toner little-by-little from an outlet or a small opening provided in the developer supply container to a supply port of a developing device. In discharging toner in this way, since it is difficult for toner to be discharged automatically by the force of gravity, some toner feeding means is necessary.

Such a process is capable of supplying toner just enough and maintaining an amount of toner constant in a developing device. It is also effective, in particular, for maintaining a ratio of mixing a carrier component and a toner component always at a constant level if a two-component developer is used.

As described above, a so-called stationary developer supply container is effective for stabilizing levels of a discharge amount of toner and a ratio of mixing a carrier component and a toner component in a two-component developer. However, as a quality of an image has been getting higher in an electrophotographic image forming apparatus in recent years, there are more serious needs for stabilizing the level of the mixing ratio.

In order to stabilize the levels of the discharge amount and the mixing ratio, it is important to realize how to stabilize an amount of toner discharged from the outlet from the time when the developer supply container is sufficiently filled with a developer to the time when the developer supply container becomes almost empty.

In addition, since toner is a fine powder, it is necessary to seal a combining part between containers such that the toner does not leak. However, it is almost impossible to perfectly prevent the toner from leaking out of the combining part due to an effect of vibration or the like at the time when a container is attached or detached no matter how the combined part is sealed. Thus, it is desirable to reduce the number of parts requiring sealing, such as a combining part between containers, as much as possible.

SUMMARY OF THE INVENTION

The present invention has been devised in view of the above problems, and it is an object of the present invention to provide a developer supply container that always supply a stabilized amount of a developer and an image forming apparatus capable of mounting the container thereon.

It is another object of the present invention to provide a developer supply container capable of reducing sealing parts and an image forming apparatus capable of mounting the container thereon.

It is another object of the present invention to provide a developer supply container that includes:

a containing chamber for containing a developer;

a first feeding member, which is provided in the containing chamber and which feeds the developer to an outlet of the containing chamber;

a feeding chamber communicating with the containing chamber;

a second feeding member, which is provided in the feeding chamber and which feeds the developer coming from the containing chamber to an outlet of the container;

a partition member for partitioning said developer supply container into said containing chamber and said feeding chamber, wherein a partitioning area of said partition member is much larger than an area of said outlet of said containing chamber.

It is yet another object of the present invention to provide an image forming apparatus that includes:

developing means for developing a latent image formed on an image bearing member; and a developer supply container for supplying developer to the developing means, the developer supply container being detachably mountable to the image forming apparatus, wherein the developer container includes:

a containing chamber for containing a developer;

a first feeding member, which is provided in the containing chamber and which feeds the developer to an outlet of the containing chamber;

a feeding chamber communicating with the containing chamber;

a second feeding member, which is provided in the feeding chamber and which feeds the developer coming from the containing chamber to an outlet of the container;

a partition member for partitioning said developer supply container into said containing chamber and said feeding chamber, wherein a partitioning area of said partition member is much larger than an area of said outlet of said containing chamber.

Other objects, features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Figure 1:
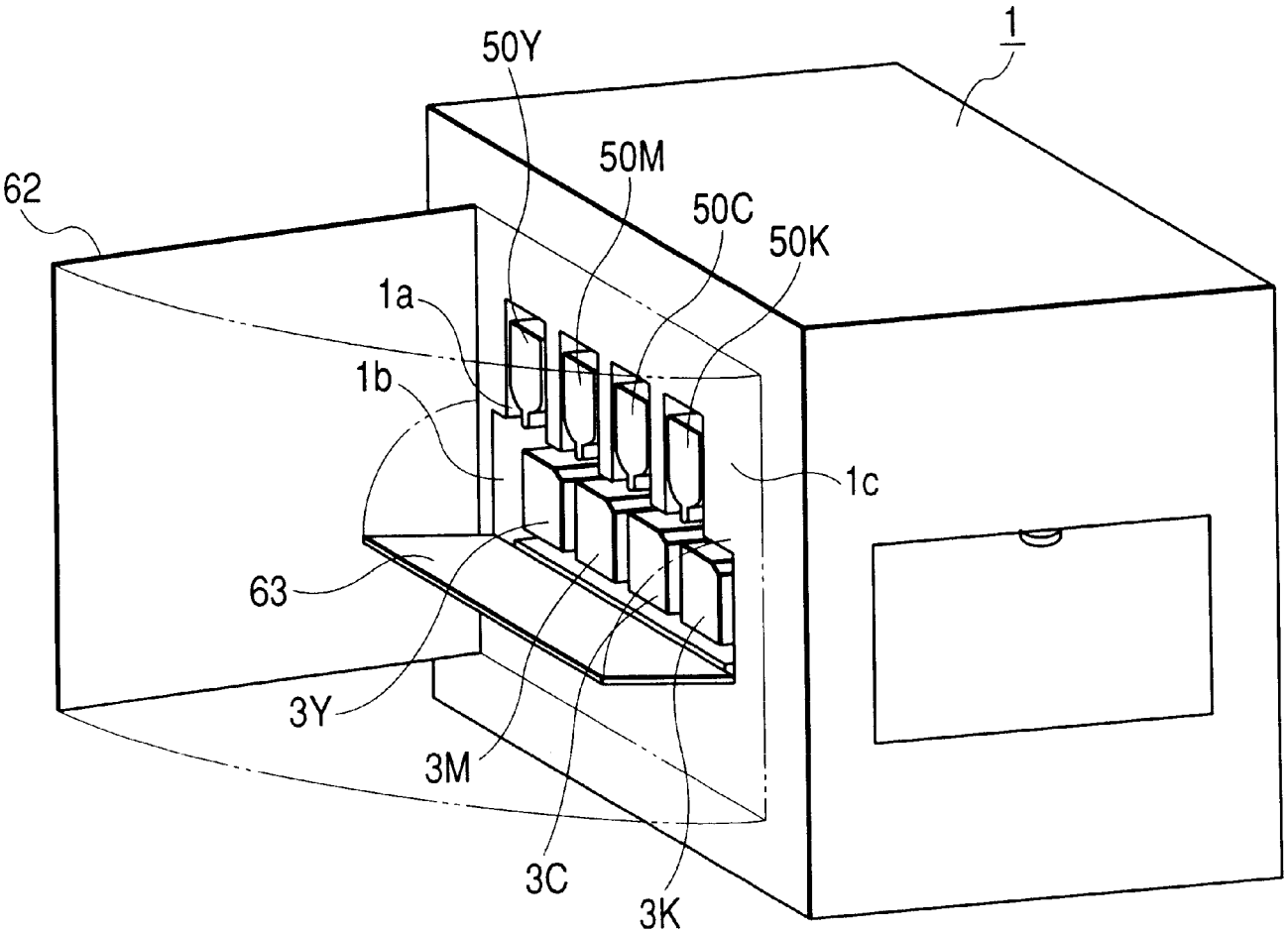
FIG. 1 is an external perspective view of an image forming apparatus in accordance with the present invention.
Figure 2:
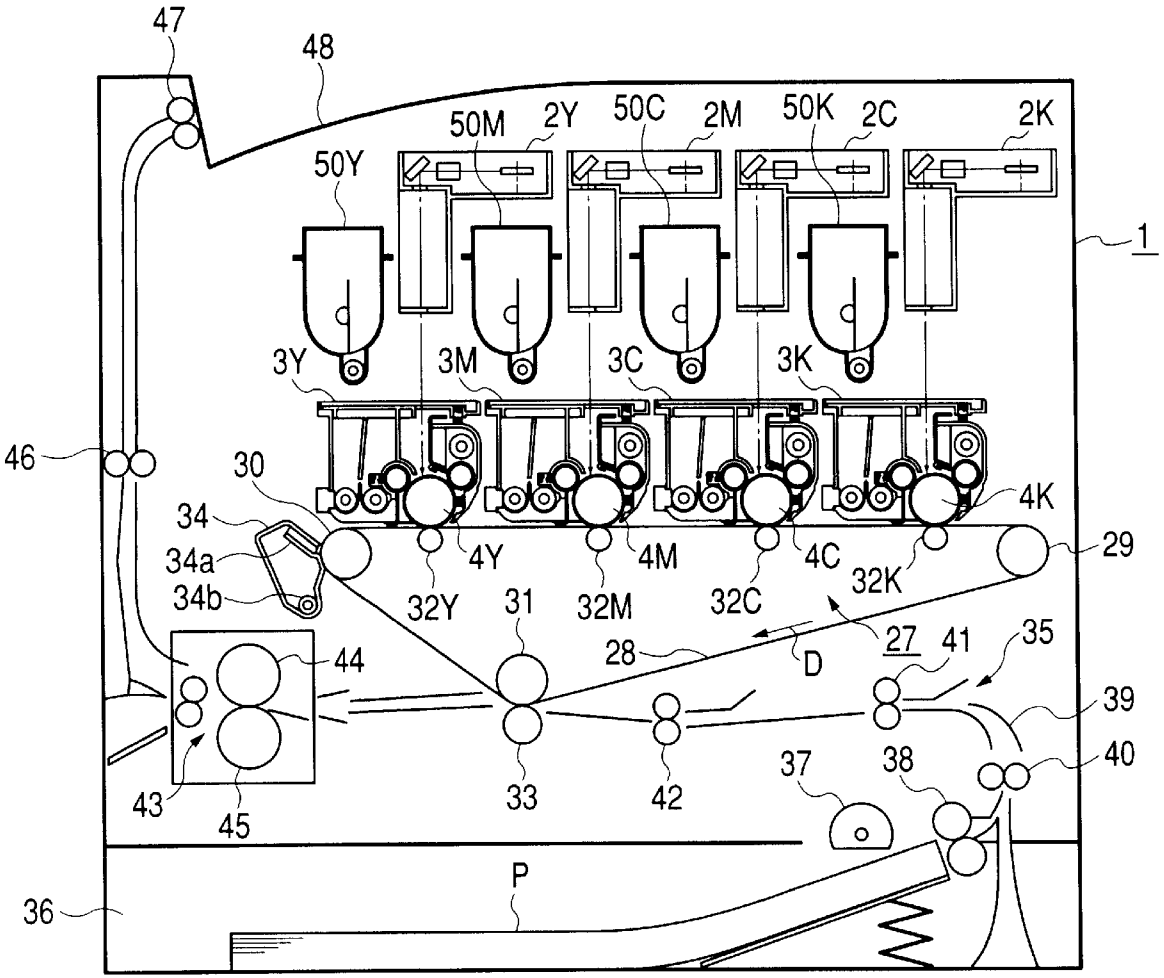
FIG. 2 is an overall view of the image forming apparatus.
Figure 3:
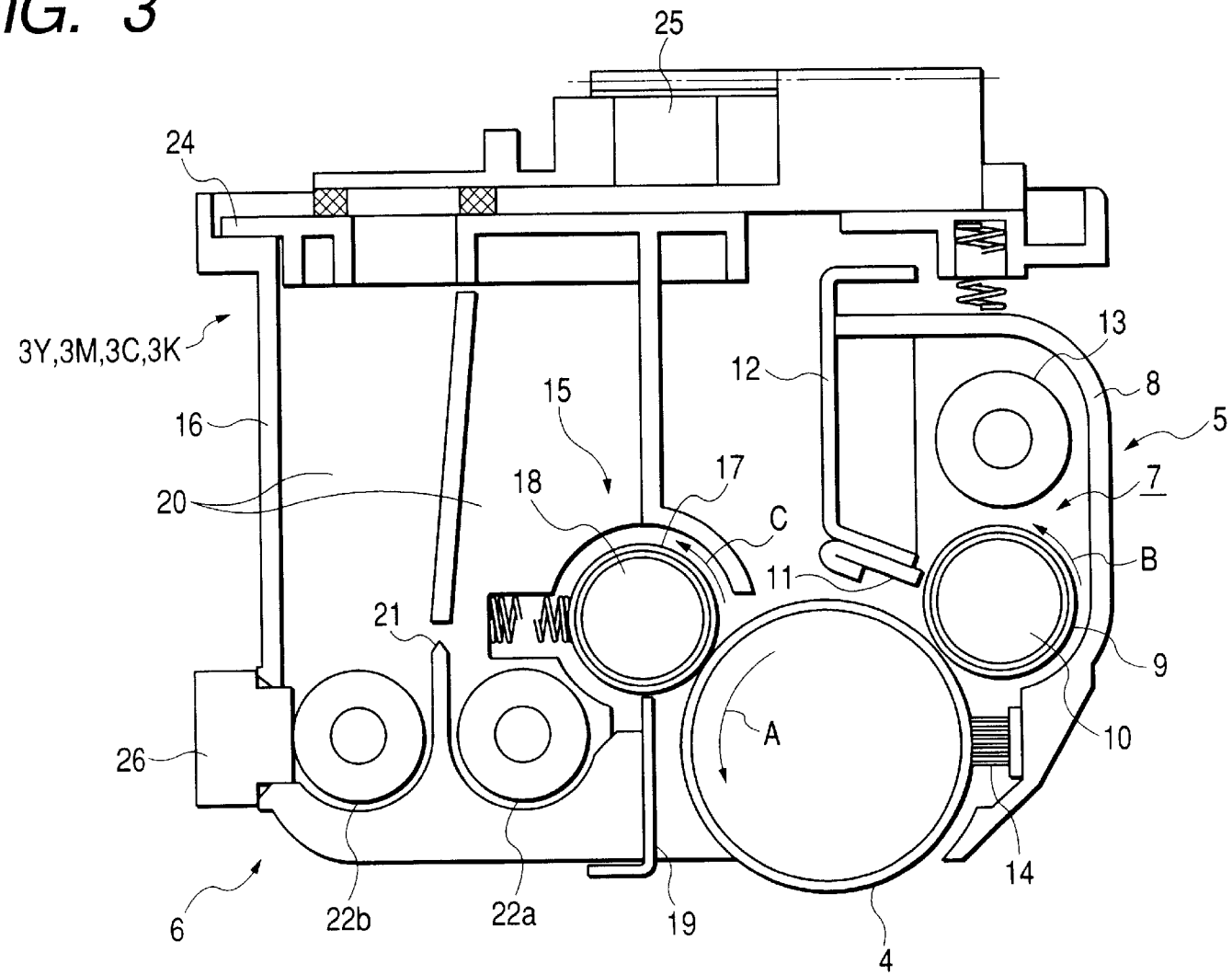
FIG. 3 illustrates a configuration of a process cartridge.
Figure 4:
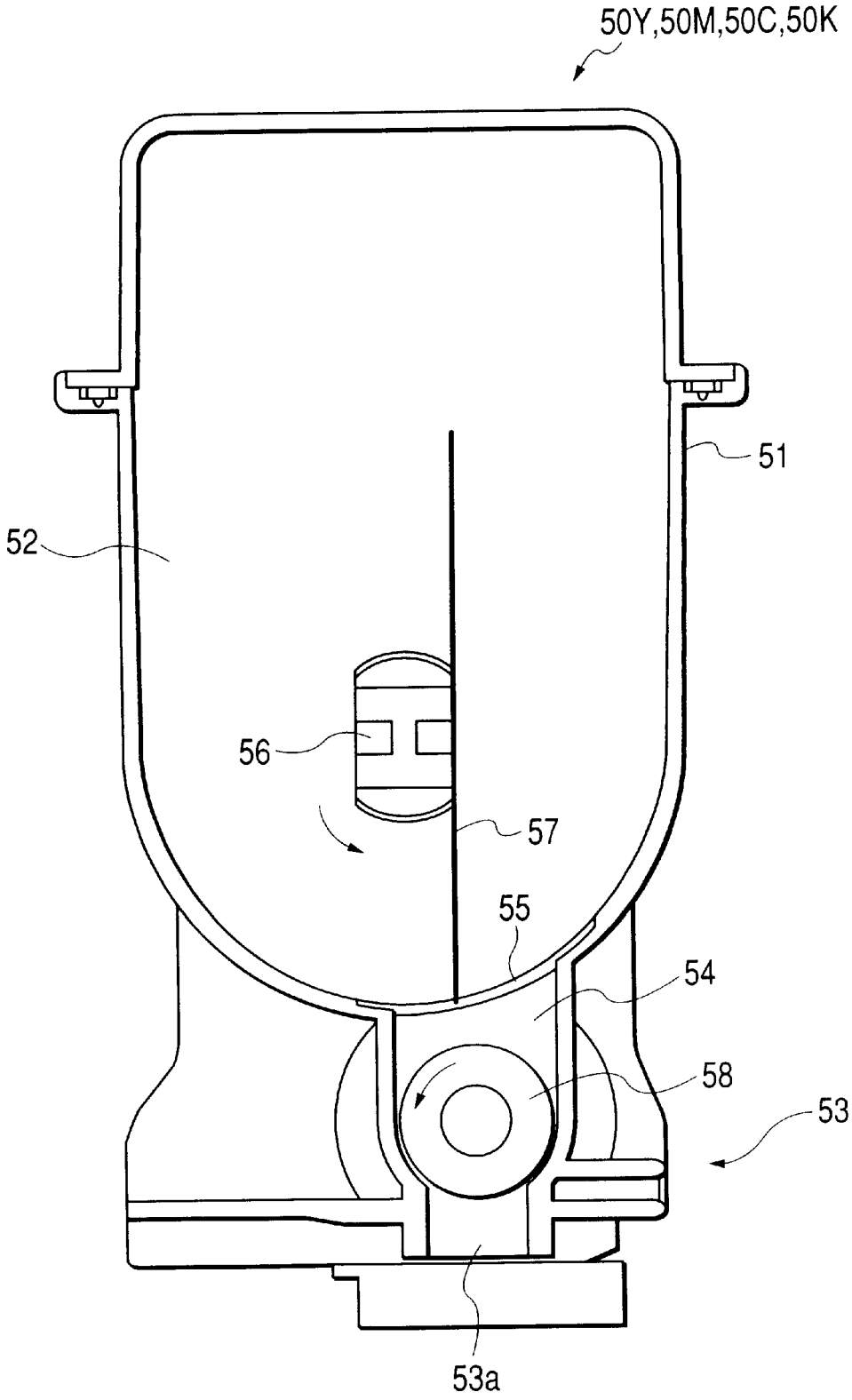
FIG. 4 is a vertical sectional view of a developer supply container.
Figure 5:
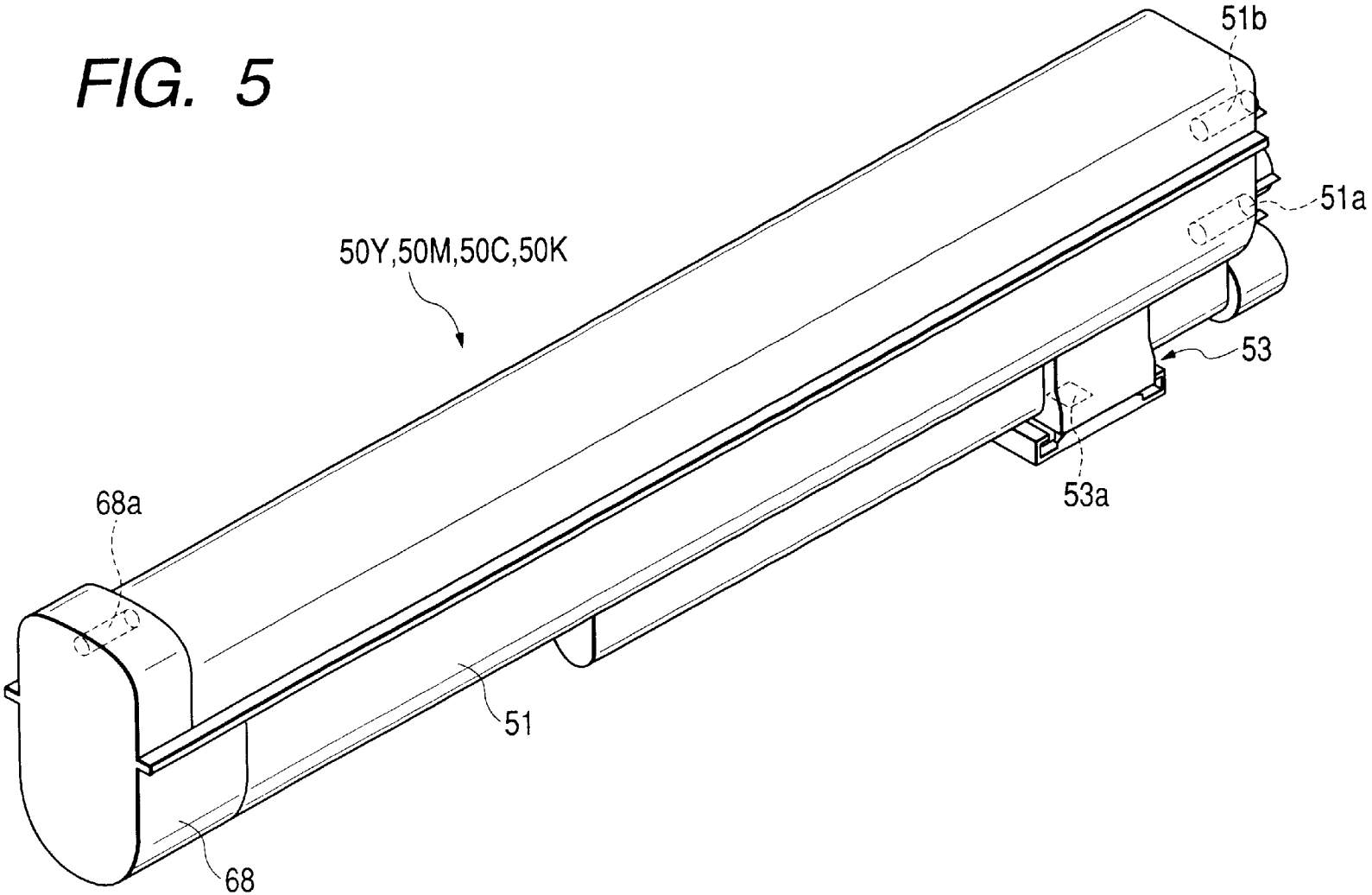
FIG. 5 is an external perspective view of the developer supply container.
Figure 6:
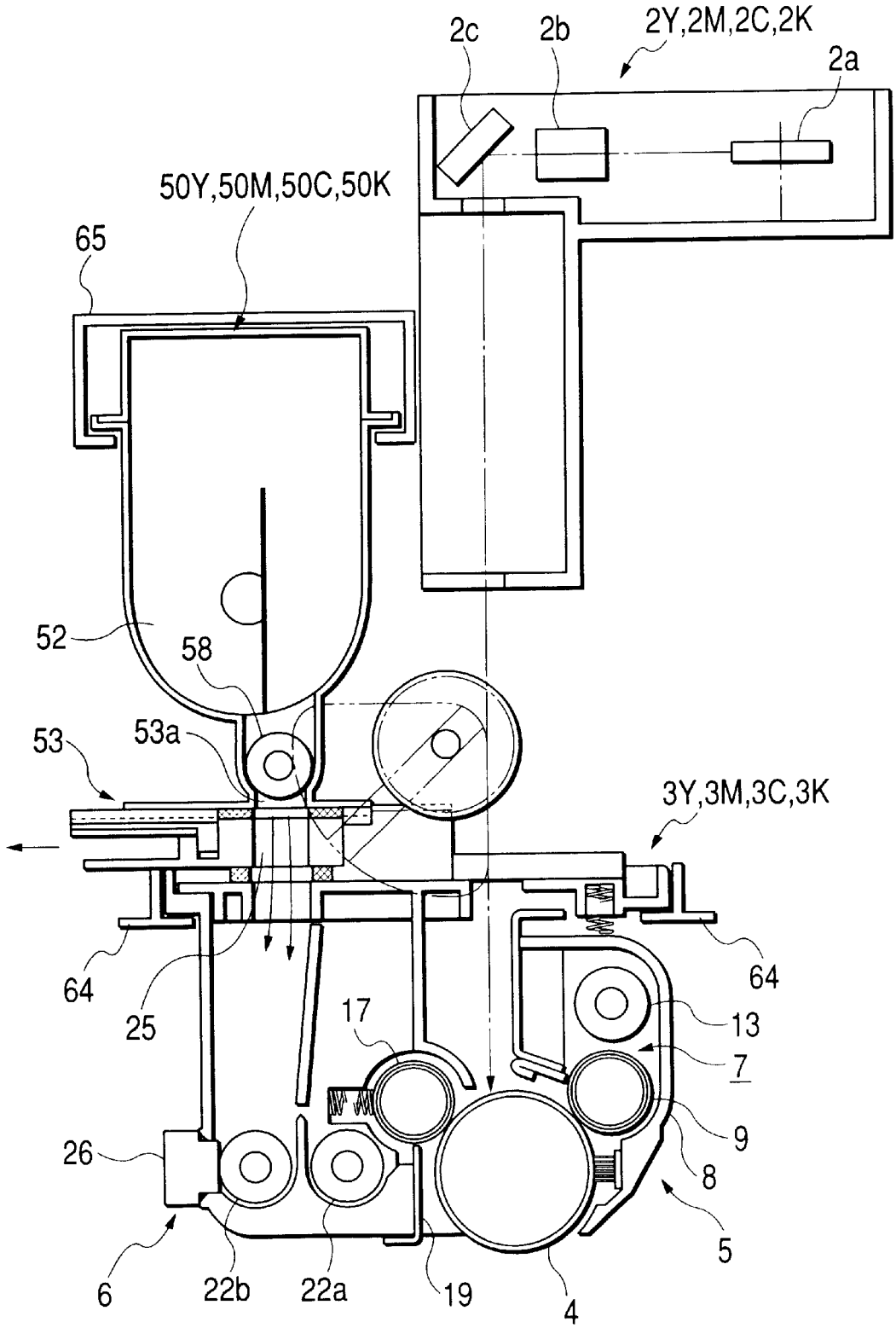
FIG. 6 illustrates a state in which the developer supply container is mounted on the process cartridge.
Figure 7:
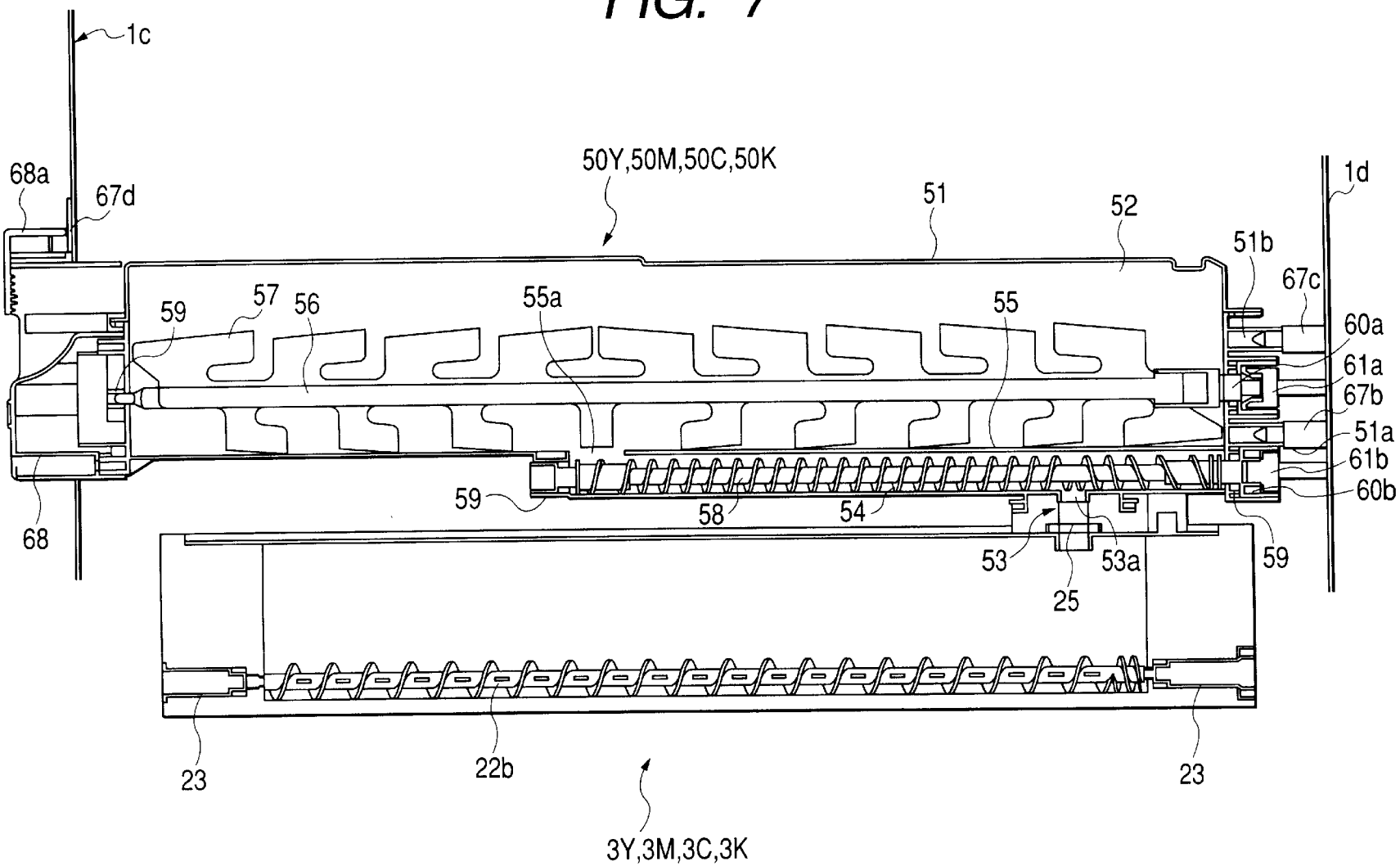
FIG. 7 is a longitudinal sectional view of the developer supply container.
Figure 8:
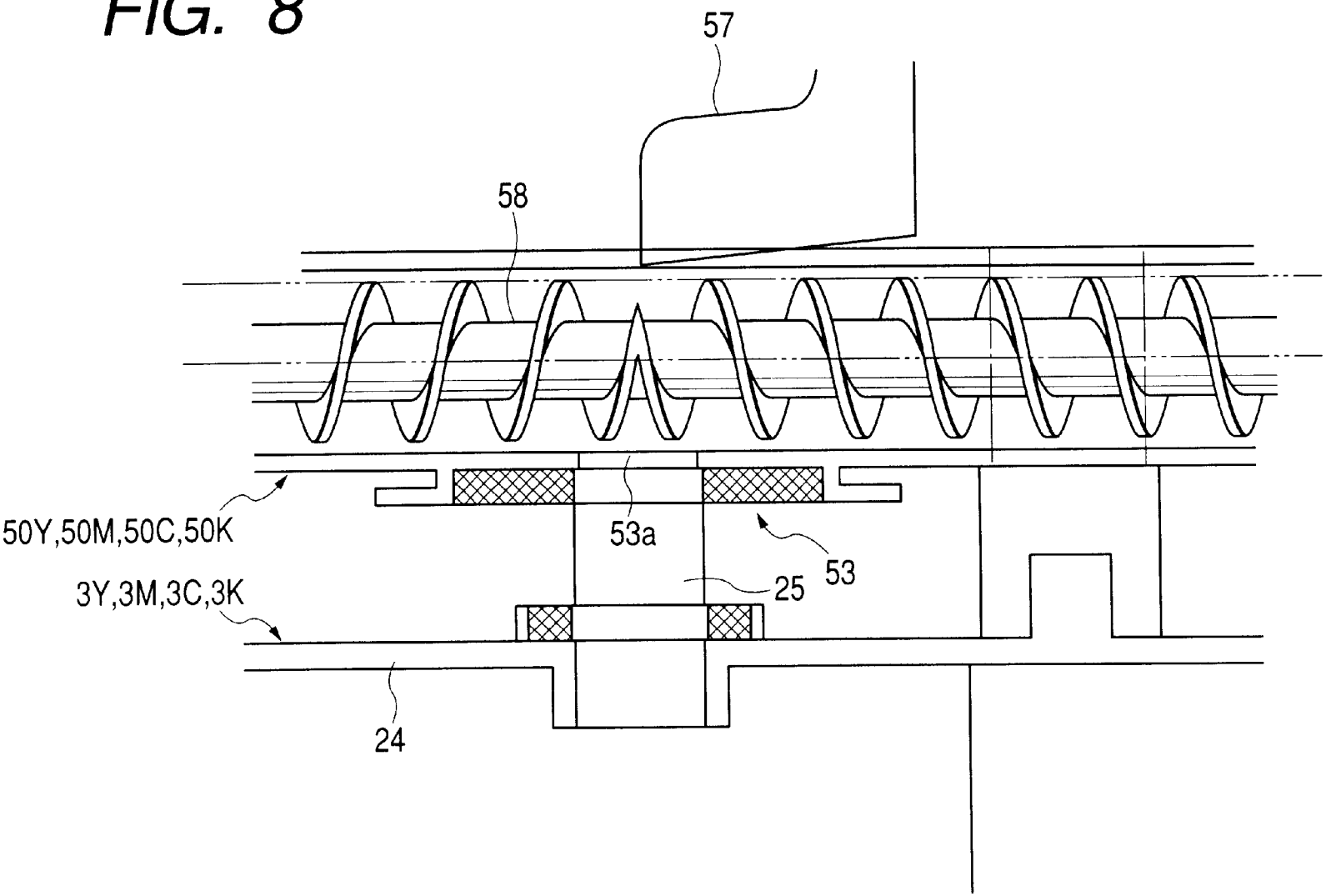
FIG. 8 is an enlarged view of the vicinity of an outlet.
Figure 9:
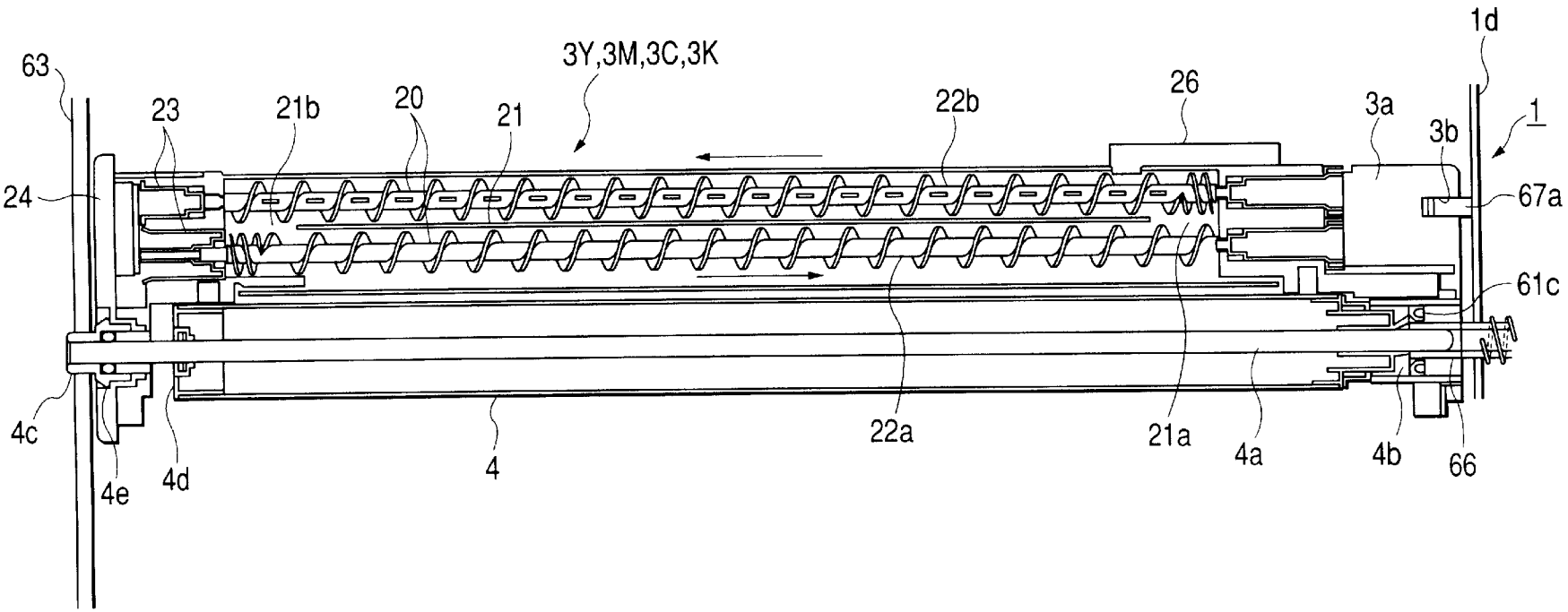
FIG. 9 is a longitudinal sectional view of the process partridge.
Figure 10:
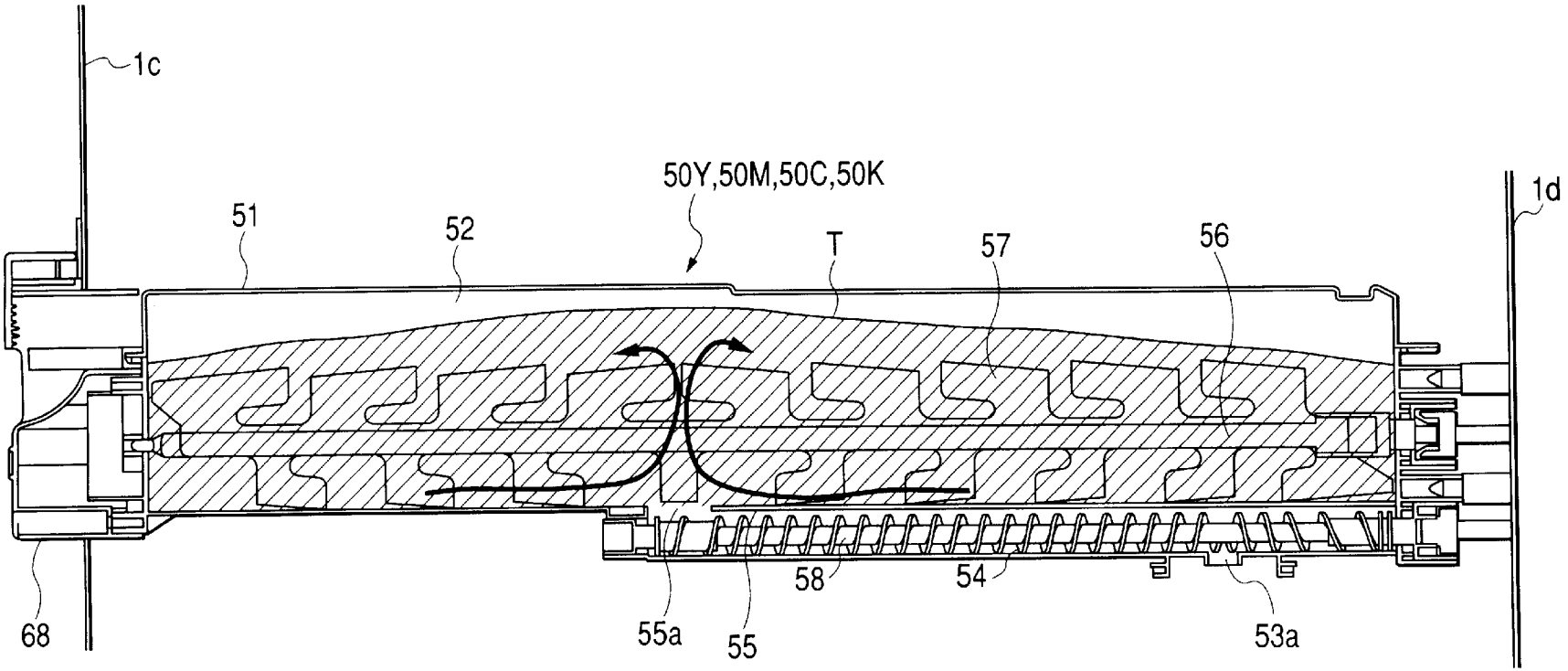
FIG. 10 illustrates a state in which a toner containing portion 52 is sufficiently filled with toner.
Figure 11:
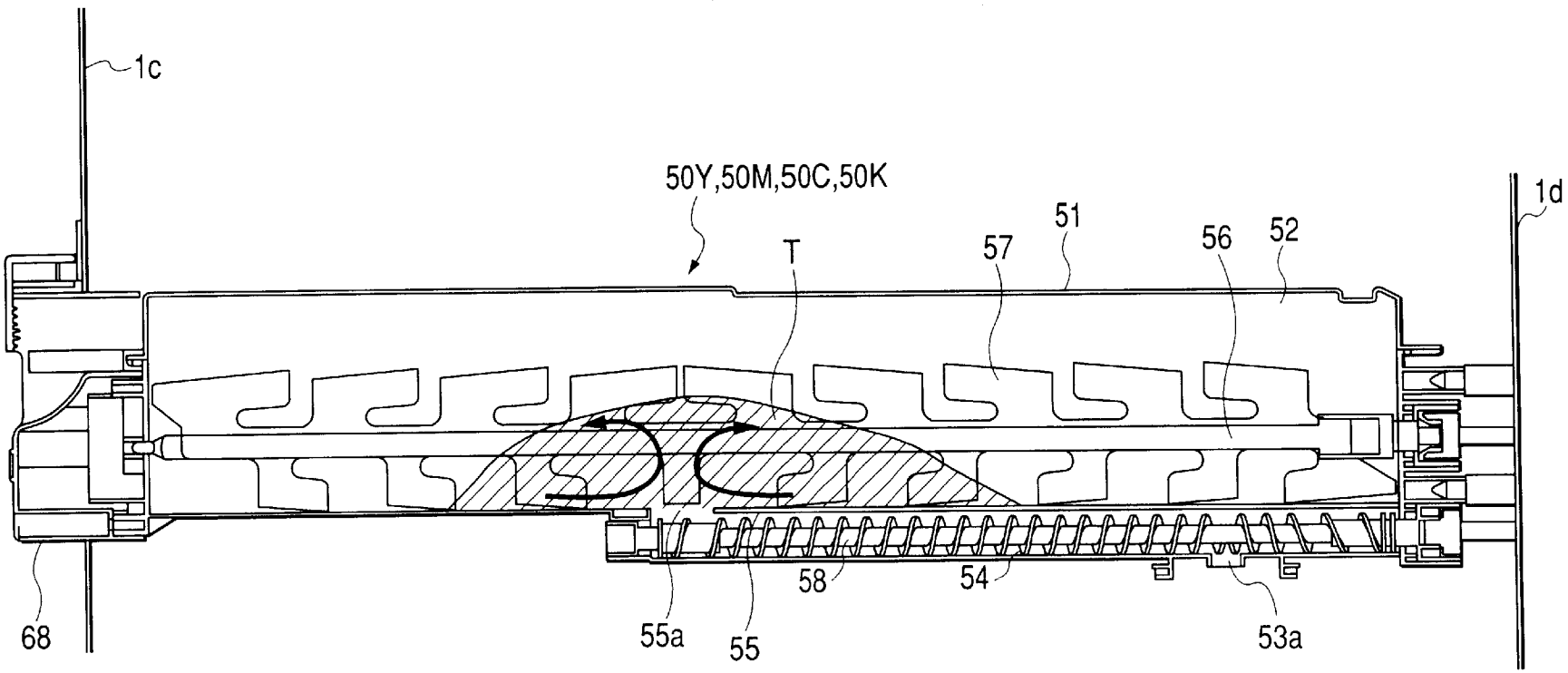
FIG. 11 illustrates a state in which the toner in the toner containing portion 52 decreases.
Figure 12:
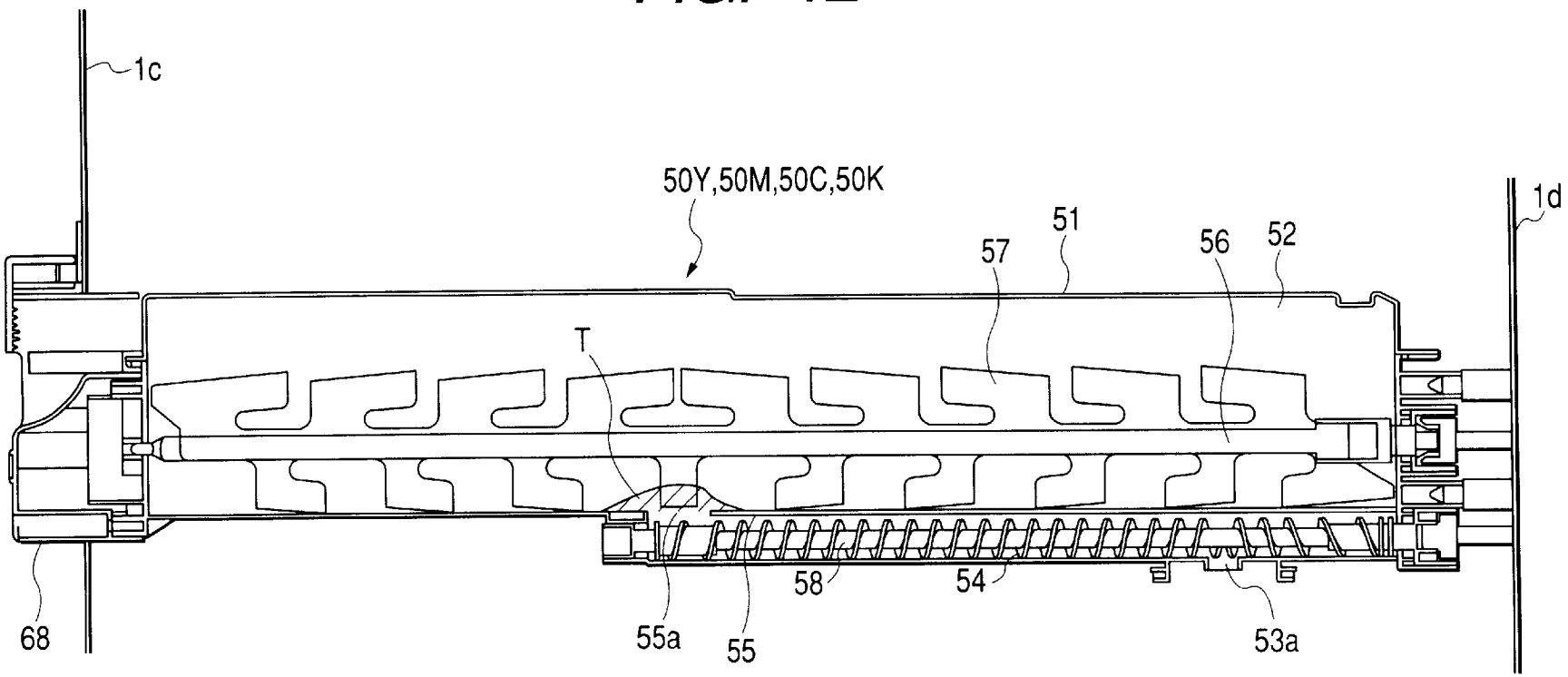
FIG. 12 illustrates a state in which the toner in the toner containing portion 52 is running out.

Embodiments of a developer supply container and an image forming apparatus in accordance with the present invention will be described with reference to the drawings. FIG. 1 is an external perspective view of an image forming apparatus in accordance with this embodiment, FIG. 2 is an overall view of the image forming apparatus in accordance with this embodiment, FIG. 3 illustrates a configuration of a process cartridge, FIG. 4 is a vertical sectional view of a developer supply container, FIG. 5 is an external perspective view of the developer supply container, FIG. 6 illustrates a state in which the developer supply container is mounted on the process cartridge, FIG. 7 is a longitudinal sectional view of the developer supply container, FIG. 8 is an enlarged view of the vicinity of an outlet, FIG. 9 is a longitudinal sectional view of the process cartridge, and FIGS. 10 to 12 illustrate how a developer is consumed.

In this embodiment, an image forming apparatus will be described referring to a color electrophotographic image forming apparatus as an example. Incidentally, in the following descriptions, a longitudinal direction means a direction in which a process cartridge 3 is inserted in an apparatus main body and which crosses (is substantially perpendicular to) a transporting direction of a recording medium P. This direction is the same as an axial direction of a photosensitive drum 4, or an image bearing member. In addition, left and right mean left and right viewed from the transporting direction of the recording medium P. Moreover, an upper part and a lower part mean an upper part and a lower part in a state in which the process cartridge 3 is mounted.

(Overall Configuration)

An overall configuration of an image forming apparatus will be described first with reference to FIG. 2. An image forming apparatus 1 shown in FIG. 2 has four process cartridges 3 (3Y, 3M, 3C and 3K) provided with a drum shaped electrophotographic photosensitive member (hereinafter referred to as a photosensitive drum), or an image bearing member. Laser exposing means 2 (2Y, 2M, 2C and 2K) of colors corresponding to the process cartridges 3, respectively, are arranged in parallel above the process cartridges 3. Toner is supplied to the process cartridges 3 by toner supply containers 50 (50Y, 50M, 50C and 50K) or developer supply containers to be described later, and toner images or developer images are formed on the photosensitive drum 4. The formed toner images are superimposed to be transferred on an intermediate transfer belt 28.

Sheet transporting means 35 for transporting the recording medium P is disposed below the image forming apparatus. The sheet transporting means 35 transports the recording medium P so that the toner images on the intermediate transfer belt 28 are collectively transferred on the recording medium P. Thereafter, a fixing device 43 fixes the toner images and then the recording medium P is delivered to the outside of the apparatus. Here, the recording medium P is, for example, a sheet of paper, an OHP sheet and a cloth. The image forming apparatus in this embodiment is a cleanerless system, which collects transfer residual toner left on the photosensitive drum 4 in developing means 6, and a cleaner for collecting and storing the transfer residual toner is not disposed in the process cartridge 3.

In addition, in this embodiment, a developer is a two-component developer in which a toner component and a carrier component are mixed. Negative chargeable toner with an average particle diameter of 6 $\mu$m is used as toner, and a magnetic carrier with a saturation magnetization of 205 emu/cm$^3$ and an average particle diameter of 35 $\mu$m is used as a magnetic carrier. In addition, a mixture of a toner component and a carrier component mixed at a weight ratio of 6:94 is used as a developer. A configuration of each part of the image forming apparatus will be hereinafter described sequentially.

(Process Cartridge)

The process cartridges 3Y, 3M, 3C and 3K (yellow, magenta, cyan and black) are integrally formed with charging means 5 and developing means 6 arranged around the photosensitive drum 4 as shown in FIG. 3. A user can easily attach and detach these process cartridges 3 to and from an image forming apparatus main body (hereinafter simply referred to as an apparatus main body 1), and replace them when the photosensitive drum 4 has run down. For example, in this embodiment, the number of rotations of the photosensitive drum 4 is counted, and when the number of rotations exceeds a predetermined count, a user is informed that a process cartridge has run down.

The photosensitive drum 4 in accordance with this embodiment is a negative chargeable organic photoconductor, has a photoconductive layer, which is usually used, on a drum substrate of aluminum with a diameter of approximately 30 mm, and is provided with a charge injection layer as a top layer. The photosensitive drum 4 is rotated to be driven at a predetermined process speed, at approximately 117 mm/sec in this embodiment. The charge injection layer uses a coating layer of a material in which, for example, $SnO_2$ ultra-fine particles are dispersed as conductive fine particles in a binder of insulating resin.

A drum flange 4*b* is fixed in a deep end part of the photosensitive drum 4 (see FIG. 9), and a driven flange 4*d* is fixed in a front end part. The centers of the drum flange 4*b* and the driven flange 4*d* are penetrated by a drum shaft 4*a*, and the drum shaft 4*a*, the drum flange 4*b* and the driven flange 4*d* are integrally rotated. That is, the photosensitive drum 4 is rotated around the drum shaft 4. The front end part of the drum shaft 4*a* is rotatably supported by a bearing 4*e*, which is fixed to a bearing case 4*c*. The bearing case 4*c* is fixed to a frame 3*a* of the process cartridge 3.

(Charging Means)

The charging means in accordance with this embodiment employs a contact charging method, and employs a magnetic brush charging device 7 using magnetic particles as a charging member. More specifically, a magnetic brush portion is formed by magnetically binding conductive magnetic particles as a charging member, the magnetic brush portion is brought into contact with the photosensitive drum 4 and a voltage is applied to the magnetic brush portion, whereby a photoconductor is charged.

Such a charging method (charging of a charged body by direct injection of charge) is referred to as an injection charging process. With this injection charging process, a cleaner mechanism (a cleaning blade, a cleaning roller or the like) for mechanically scraping off and removing transfer residual toner on the photosensitive drum 4 becomes unnecessary. This cleaner-less system will be described later. In addition, the injection charging process of this embodiment does not utilize a discharge phenomenon in which charging to a charged body is performed using a corona charger. Thus, an applied charge bias required for charging is a bias only in the amount of a desired surface potential of a member to be charged. In addition, the process is perfect ozone-less with no generation of ozone and is low-power consumption charging.

The magnetic brush charging device 7 of this embodiment will now be described in detail with reference to FIG. 3. In the magnetic brush charging device 7, a magnetic brush portion of magnetic particles is formed on a charging sleeve 9 enclosing a magnet roller 10, and the photosensitive drum 4 is charged to a predetermined potential at an abutment portion between the photosensitive drum 4 and the magnetic brush portion.

The charging sleeve 9 is disposed in the longitudinal direction over an opening of a charging container 8 containing the magnetic particles with a substantially left half of its circumferential surface protruding outside. An agitating member 13 is disposed in the charging container substantially parallel with the charging sleeve 9. The agitating member 13 is disposed above the charging sleeve 9 and is rotatably supported between walls in both end parts in the longitudinal direction.

Moderately coarse unevenness is formed on the surface of the charging sleeve 9 in order to satisfactorily transport the magnetic particles. The magnet roller 10 provided inside the charging sleeve 9 is provided with four magnetic poles in the circumference direction. The magnetic roller 10 is fixed such that one magnetic pole opposes it in the direction to the center of the photosensitive drum 4 in order to prevent the magnetic particles from adhering to the photosensitive drum 4 and being carried in accordance with rotation.

A nonmagnetic regulating blade 11 of a plate shape is supported by the charging container 8 via a supporting plate 12 with a predetermined distance apart from the surface of the charging sleeve 9. When the magnetic particles are held by the magnet roller 10 and carried in a direction indicated by the arrow B by the rotation of the charging sleeve 9, the magnetic particle is regulated to a predetermined thickness by the regulating blade 11 and forms a magnetic brush portion on the charging sleeve 9. The charging sleeve 9 is disposed opposite to the photosensitive drum 4 with a predetermined distance apart from it. The charging sleeve 9 allows the magnetic brush portion formed on the charging sleeve 9 to contact the surface of the photosensitive drum 4 and forms a charge nip portion. The width of the charge nip portion affects the charging property of the photosensitive drum 4. In this embodiment, the distance is adjusted such that the width of the nip portion is approximately 6 mm.

A predetermined charging bias is applied from a not-shown charging bias source to the magnetic brush portion via the charging sleeve 9. The photosensitive drum 4 is subjected to the contact charging processing to have a predetermined polarity and potential. As the magnetic particles forming the magnetic brush portion, magnetic metal particles such as ferrite and magnetite or particles obtained by binding these magnetic particles with resin can also be used.

The charging sleeve 9 is rotated to be driven in the direction indicated by the arrow B, which is a counter direction with respect to the rotation of the photosensitive drum 4 or a member to be charged in a direction indicated by the arrow A, in the opposing portion by a not-shown motor. In this embodiment, the charging sleeve 9 is rotated at a velocity ratio of $V2 \cong 1.5 \times V1$ in the counter direction with respect to a rotational speed V1 of the photosensitive drum 4. The faster the relative rotational speed between the photosensitive drum 4 and the magnetic brush portion the more the opportunity of contact increases. Thus, uniformity of charging becomes better, and absorption of transfer residual toner into a magnetic brush tends to be improved.

In addition, a charging brush 14 is disposed upstream of the charging sleeve 9 in the rotating direction of the photosensitive drum 4 and contacts the surface of the photosensitive drum 4 in an inroad amount of approximately 1 mm to apply a predetermined voltage to it. Transfer residual toner on the photosensitive drum 4 is scattered uniformly by this contact of the charging brush 14. Moreover, a charge elimination is performed so that charging in the next step is performed uniformly.

(Exposing Means)

Exposure on the photosensitive drum 4, which is uniformly charged as described above, is performed using the laser exposing means 2Y, 2M, 2C and 2K (laser beam optical scanning systems) in this embodiment. That is, when an image signal is transmitted from the apparatus main body 1, the uniformly charged surface of the photosensitive drum 4 is subject to scanning exposure of laser beam L modulated in response to this signal (see FIG. 6). Then, an electrostatic latent image corresponding to image information is selectively formed on the photosensitive drum 4.

As shown in FIG. 6, the laser exposing means 2 (2Y, 2M, 2C and 2K) has a not-shown solid laser element, a polygon mirror 2*a*, an imaging lens 2*b* and a reflective mirror 2*c*. When the solid laser element controls on/off of light emission at predetermined timing by a not-shown light emitting signal generator based on the inputted image signal, laser beam L irradiated from the solid laser element is converted into substantially parallel rays by a not-shown collimator lens system and is scanned by the polygon mirror 2*a* rotating at a high speed. Then, the laser beam L is imaged in a spot shape on the photosensitive drum 4 via the imaging lens 2*b* and the reflective mirror 2*c*.

In this way, the exposure in a main scanning direction by the laser beam scan and the exposure in a subscanning direction by the photosensitive drum 4 rotating are performed on the photosensitive drum 4, and an exposure distribution according to an image signal is obtained. That is, a bright section potential with a decayed potential and a dark section potential with an nondecayed surface potential are formed by irradiating and not irradiating the laser beam L. Then, an electrostatic latent image corresponding to image information is formed by a contrast between the bright section potential and the dark section potential.

(Developing Means)

A developing device 15 or developing means is a two-component contact developing device (two-component magnetic brush developing device) and holds a two-component developer consisting of a carrier and toner on a developing sleeve 17 or a developer bearing member incorporating a magnet roller 18 therein. A regulating blade 19 is provided with a predetermined distance apart from the developing sleeve 17 and forms a thin layer developer on the developing sleeve 17 in accordance with the rotation of the developing sleeve 17 in a direction indicated by the arrow C.

The regulating blade 19 is fixedly supported by a developing container 16. The developing sleeve 17 is disposed in parallel with the photosensitive drum 4 with a predetermined distance apart from it. The developing sleeve 17 is set such that development can be performed in the state in which a developer layer formed on the developing sleeve 17 contacts the photosensitive drum 4 at the time of development. The developing sleeve 17 is rotated at a predetermined speed in the direction indicated by the arrow C as a counter direction to the rotational direction of the photosensitive drum 4 in the development portion.

A developer containing portion 20 in which a developer circulates is partitioned into two, except both ends, by a partition wall 21 in the longitudinal direction as shown in FIGS. 3 and 9. Agitating screws 22*a* and 22*b* are disposed with this partition wall 21 interposed between them. The agitating screws 22*a* and 22*b* are rotatably supported on both side surfaces of a frame 24 of the process cartridge 3 via a bearing 23 (see FIG. 9).

A supply port 25 is provided in the upper part of the process cartridge 3. Toner supplied from a toner supply container 50 to be described later falls in the front side of the agitating screw 22*b*, is fed to the back side in the longitudinal direction while being agitated with a carrier and passes through a part 21*a* in the back side end, which does not have the partition wall 21. Then, the toner is further transported to the front side in the longitudinal direction by the agitating screw 22*a*, passes through a part 21*b*, not having the partition wall 21, on the front side and is transported to the agitating screw 22*b*, thereby repeating circulation.

The electrostatic latent image formed on the photosensitive drum 4 will now be described in relation to a developing step, which visualizes the latent image by the two-component magnetic brush method using the developing device 15, and a circulation system of a developer.

As the developing sleeve 17 rotates, developer in the developing container 16 is drawn to the surface of the developing sleeve 17 by an N3 pole of the magnet roller 18 and transported. In the step of transporting the developer, a layer thickness of the developer is regulated by the regulating blade 19 vertically disposed with respect to the developing sleeve 17, and a thin layer developer is formed on the developing sleeve 17. When the thin layer developer is transported to the N1 pole or a developing pole corresponding to the development portion, a magnetic brush is formed by a magnetic force. The latent image on the surface of the photosensitive drum 4 is developed as a toner image by the toner in this developer which stands like the ears of rice. In this embodiment, the electrostatic latent image is reversally developed.

The thin layer developer on the developing sleeve 17, which has passed through the development portion, continuously enters the developing container 16 in accordance with the rotation of the developing sleeve 17, leaves the developing sleeve 17 by a repulsive magnetic field between the N2 pole and the N3 pole and is returned to a developer reservoir in the developing container 16. A direct current (DC) voltage and an alternating current (AC) voltage from a not-shown source are applied to the developing sleeve 17. In this embodiment, the direct current voltage of −500V and the alternating current voltage being a peak-to-peak voltage of 1,500V at the frequency of 2,000 Hz are applied, whereby development is selectively performed in only exposed part of the photosensitive drum 4.

Although a development efficiency is improved and a quality of an image becomes higher in general when an alternating current voltage is applied in the two-component development method, a fog tends to be generated to the contrary. Therefore, a fog is usually prevented by generating a potential difference between a direct current voltage applied to the developing sleeve 17 and a surface potential of the photosensitive drum 4. More specifically, a bias voltage of a potential difference between a potential of an exposed part and an unexposed part of the photosensitive drum 4 is applied. This potential difference for preventing a fog is called a fog removal bias (V back). With this potential difference, toner is prevented from adhering to a nonimage region (unexposed part) on the photosensitive drum 4 at the time of development, and transfer residual toner on the photosensitive drum 4 is also collected in an apparatus of the cleaner-less system (cleaning simultaneous with developing).

When toner is consumed by development, a toner density in a developer decreases. A density detection sensor 26 for detecting a density of toner is disposed in a position adjacent an external circumference surface of the agitating screw 22*b* in this embodiment. When the density detection sensor 26 detects that the density of the toner in the developer becomes lower than a predetermined density level, the density detection sensor 26 orders to supply toner from the toner supply container 50 to the developing device 15. The toner density of the developer is always maintained at a predetermined level by this toner supplying operation.

(Cleaner-less System)

A cleaner-less system in a reversal development system for negatively charging the photosensitive drum 4 and attaching the negatively charged toner to a low potential part of the exposed part will now be described. In particular, a part of positively charged toner among transfer residual toner, which is left on the photosensitive drum 4 in a small amount after transfer, is electrostatically taken first in the magnetic brush charging device 7 once. The other parts of toner is also collected by forcible scraping using a brush. Then, the toner is charged to a negative polarity by the friction with magnetic particles in the magnetic brush charging device 7 and, then, discharged onto the photosensitive drum 4.

On the other hand, a part of still negatively charged toner among the transfer residual toner is hardly taken in the magnetic brush charging device 7 and is collected in the developing device 15 together with the foregoing toner discharged from the magnetic brush charging device 7 (cleaning simultaneous with development). This uptake of toner in the developing device 15 in the cleaning simultaneous with development is performed by a fog removal vias (a fog removal potential difference that is a potential difference between a direct current voltage to be applied to the developing device and the surface potential of the photosensitive drum 4) at the time of development.

According to this method, a part of transfer residual toner is collected in the developing device through the magnetic brush charging device and the rest is directly collected in the developing device to be used in the next step, whereby waste toner is eliminated and labor required for maintenance can be reduced. In addition, as it is cleaner-less, an advantage for a space is large and an image forming apparatus can be miniaturized significantly.

(Transferring Means)

A intermediate transfer unit 27 or transferring means secondarily transfers a plurality of toner images, which are primarily transferred from the photosensitive drum 4 sequentially and superimposed, collectively to a recording medium P. The intermediate transfer unit 27 is provided with an intermediate transfer belt 28 that travels in a direction indicated by the arrow D as shown in FIG. 2, and travels at a peripheral speed substantially the same as a peripheral speed of a the photosensitive drum 4. This intermediate transfer belt 28 is an endless belt with the circumferential length of approximately 940 mm and is looped around a driving roller 29, a driven roller 30 and a secondary transfer opposed roller 31.

Moreover, transfer charging rollers 32Y, 32M, 32C and 32K are rotatably disposed, respectively, in positions opposing the photosensitive drums 4 in the intermediate transfer belt 28 and are pressed in the direction of the center of the photosensitive drum 4. The transfer charging roller 32 is supplied electricity from a not-shown high voltage source, charged to a polarity opposite the polarity of the toner from the back side of the intermediate transfer belt 28 and primarily transfers the toner images on the photosensitive drum 4 onto the upper surface of the intermediate transfer belt 28 sequentially.

A secondary transfer roller 33 or a transfer member is in pressure contact with a position opposing the secondary transfer opposed roller 31 in the secondary transfer portion. The secondary transfer roller 33 is swingable vertically and rotatable in FIG. 2. Since a bias is applied to the intermediate transfer belt 28 simultaneously at this point, the toner images on the intermediate transfer belt 28 is transferred to the recording medium P. Further, the intermediate transfer belt 28 and the secondary transfer roller 33 are independently driven, respectively.

When the recording medium P rushes into the secondary transfer portion, a predetermined bias is applied to the secondary transfer roller 33, and the toner images on the intermediate transfer belt 28 is secondarily transferred to the recording medium P. At this point, the recording medium P that is put between the secondary transfer roller 33 and the intermediate transfer belt 28 is subjected to a transfer step and is transported in the left direction in FIG. 2 at a predetermined speed, to a fixing device in which the next step is performed.

A cleaning unit 34, which is separably contactable to the surface of the intermediate transfer belt 28, is provided in a predetermined position of the intermediate transfer belt 28 that is in the most downstream side of the transfer step. The cleaning unit 34 removes transfer residual toner left on the intermediate transfer belt 28 after the secondary transfer. A cleaning blade 34*a* for removing transfer residual toner is disposed in the cleaning unit 34. The cleaning unit 34 is swingably attached to a not-shown rotational center and is in pressure contact with the intermediate transfer belt 28 in the direction of cutting into it. The transfer residual toner taken in the cleaning unit 34 is fed to a not-shown waste toner tank by a feeding screw 34*b* and stored therein.

Here, a belt made of polyimide resin can be used as the intermediate transfer belt 28. Materials for the intermediate transfer belt 28 are not limited to polyimide resin, and plastics such as polycarbonate resin, polyethylene terephthalate resin, polyvinylidene fluoride resin, polyethylene naphthalate resin, polyether ether ketone resin, polyether sulfone resin and polyurethane resin, rubbers of fluorine series and silicon series can be preferably used.

(Sheet Transporting Means)

Sheet transporting means 35 transports the recording medium P to the image forming portion and is composed mainly of a feed cassette 36 in which a plurality of pieces of recording medium P are loaded and contained, a feed roller 37, a retard roller 38 for double feed protection, a feed guide 39, a registration roller pair 42 and the like. The feed roller 37 is driven to rotate according to image forming operations and separates to feed the recording medium P in the feed cassette 36 piece-by-piece. The recording medium P is guided by the feed guide 39 and transported to the registration roller pair 42 through transport roller pairs 40 and 41. The registration roller pair 42 stops its rotation immediately after the recording medium P is transported, and skew feed of the recording medium P is corrected by the recording medium P hitting the nip portion.

The registration roller pair 42 performs a non-rotational operation for allowing the recording medium P to remain stationary and wait and an operation of rotation for transporting the recording medium P toward the intermediate transfer belt 28 in a predetermined sequence. The registration roller pair 42 also performs registration of the toner images and the recording medium P at the time of a transfer step as the next step. Then, when the toner images are transferred on the recording medium P in the secondary transfer portion as described above, the recording medium P is transported to the fixing device by the driving of the intermediate transfer belt 28 and the secondary transfer roller 33.

(Fixing Device)

A fixing device 43 applies heat and pressure to the toner images transferred on the recording medium P and fixes them on the recording medium P. As shown in FIG. 2, the fixing device 43 is provided with a fixing roller 44 for applying heat to the recording medium P and a pressure roller 45 for pressurizing the recording medium P to be contacted with the fixing roller. The fixing roller 44 and the pressure roller 45 are hollow rollers, have not-shown heaters inside, respectively. The fixing roller 44 and the pressure roller 45 are driven to rotate, thereby clamping to transport the recording medium P.

That is, the recording medium P holding the toner images is transported by the fixing roller 44 and the pressure roller 45 and is applied heat and pressure, whereby the toner images are fixed on the recording medium P. The recording medium P after fixing is delivered by delivery rollers 46 and 47, and is delivered to and loaded in a delivery tray 48 on the apparatus main body 1.

(Developer Supply Container)

The developer supply container in accordance with the present invention will now be described with reference to FIGS. 2, 4, 5, 7, 8 and 9. Toner supply containers 50Y, 50M, 50C and 50K or the developer supply containers are disposed in parallel above the process cartridges 3Y, 3M, 3C and 3K and are configured detachably mountable from the front of the apparatus main body 1 (see FIG. 1).

The toner supply container 50 has a toner containing portion 52 or a developer containing portion for containing toner inside a frame 51 and a toner feeding portion 54 or a developer feeding portion for feeding toner to an outlet 53*a* as shown in FIG. 4. The toner containing portion 52 and the toner feeding portion 54 are partitioned by a partition plate 55 that is formed using a sheet member of resin. That is, the -toner supply container 50 has two chambers of the toner containing portion 52 and the toner feeding portion 54. As shown in FIG. 7, the toner containing portion 52 and the toner feeding portion 54 communicate with each other only through a receiving port 55*a* provided at one end of the partition plate 55.

On the other hand, an agitating plate 57 fixed to an agitating shaft 56 as first feeding means is disposed inside the toner containing portion 52. A screw 58 or second feeding means is disposed in the toner feeding portion 54. A discharge opening 53 having an outlet 53*a* for discharging toner is formed on the bottom surface of the toner feeding portion 54. The screw 58 and the agitating shaft 56 are rotatably supported at their both ends by bearings 59. Driving couplings (recesses) 60*a* and 60*b* are fixedly disposed in one endmost parts, respectively. The driving couplings (recesses) 60*a* and 60*b* receive the transmission of driving force from driving couplings (protrusions) 61*a* and 61*b* and are driven to rotate by an order sent by the density detection sensor 26 of the developing device 15.

The agitating plate 57 is formed of a flexible sheet member (e.g., polyethylene terephthalate). A tip of the agitating plate 57 in the rotational radius direction slopes toward the axis (see FIG. 7), whereby the tip rubs an arc part of the bottom surface of the toner supply container 50 (the bottom surface of the toner containing portion 52) at a predetermined angle. More specifically, the tip side of the agitating plate 57 is twisted to form a spiral shape. A feeding force of the agitating shaft 56 in the axial direction is generated by the twist and the slope, whereby toner is fed in the longitudinal direction. The slope of the tip of the agitating plate 57 is formed substantially symmetrical around the receiving port 55*a*, whereby the toner in the toner containing portion 52 is fed toward the receiving port 55*a* or a communicating portion with the toner feeding portion 54. The toner fed to the receiving port 55*a* is forwarded to the toner feeding portion 54 by free fall.

The contour of the screw 58 has a spiral rib shape and reverses the twist direction of the spiral around the discharge opening 53 (see FIG. 8). Then, the screw 58 is driven by the rotation of the driving coupling (protrusion) 61*b*, thereby feeding the toner toward the discharge opening 53, causing the toner to fall freely from the outlet 53*a* of the discharge opening 53, and supplying the toner to the process cartridge 3 via the supply port 25.

(Mounting the Process Cartridge and the Developer Supply Container)

Attachment and detachment of the process cartridge 3 and the toner supply container 50 will now be described with reference to FIGS. 1, 6, 7. and 9. As shown in FIG. 1, an open-closeable front door 62 is provided in front of the apparatus main body 1. When this front door 62 is opened to the front side, openings 1*a* and 1*b* are exposed, in which the process cartridge 3 and the toner supply container 50 are inserted. A rotatably supported centering plate 63 is disposed in the opening 1*b* in which the process cartridge 3 is inserted. The process cartridge 3 is attached and detached after opening and closing the centering plate 63.

A guide rail 64 for guiding the attachment and detachment of the process cartridge 3 and a guide rail 65 for guiding the mounting of the toner supply container 50 are fixed in the apparatus main body 1 as shown in FIG. 6. The direction of mounting the process cartridge 3 is parallel with the axial direction of the photosensitive drum 4. The direction of mounting the toner supply container 50 is parallel with the axial direction of the screw 58. The guide rails 64 and 65 are disposed in the same directions. The process cartridge 3 and the toner supply container 50 are slid from the front side to the back side of the apparatus main body 1 along the guide rails 64 and 65 once and inserted.

When the process cartridge 3 is inserted in the innermost part, the back side end part of the drum shaft 4*a* is inserted in a centering shaft 66 of the apparatus main body 1 as shown in FIG. 9, and the rotational center on the back side of the photosensitive drum 4 is determined with respect to the apparatus main body 1. In addition, the drum flange 4*b* and the driving coupling (protrusion) 61*c* are coupled simultaneously, thereby enabling the rotational driving of the photosensitive drum 4. Moreover, a supporting pin 67*a* for positioning the process cartridge 3 on a back side plate id is disposed. The position of the process cartridge 3 is fixed by inserting the supporting pin 67*a* in a recessed part 3*b* provided in the frame 3*a* of the process cartridge 3. In addition, in the front side of the apparatus main body 1, a bearing case 4*c* of the photosensitive drum 4 is supported to be fixed by closing the centering plate 63.

With the series of inserting operations, the process cartridge 3 and the photosensitive drum 4 are positioned with respect to the apparatus main body 1. That is, the drum shaft 4*a*, the drum flange 4*b*, the recessed part 3*b* and the bearing case 4*c* form a positioning part for positioning the process cartridge 3 in the apparatus main body 1.

On the other hand, when the toner supply container 50 is inserted into the backmost part, the supporting pin 67*b* protruding from the back side plate 1*d* is inserted in the recessed part 51*a* provided on the back side of the frame 51, whereby a standard position of the toner supply container 50 is determined. A supporting pin 67*c* also provided in the back side plate 1*d* is inserted in the recessed part 51*b* provided on the back side of the frame 51, which acts as a detent to fix the position of the frame 51 of the toner supply container 50. In addition, the driving couplings (recesses) 60*a* and 60*b* and the driving couplings (protrusions) 61*a* and 61*b* are coupled simultaneously, thereby enabling the rotational driving of the screw 58 and the agitating shaft 56.

In addition, a supporting pin 67d is provided on a front side plate 1*c* of the apparatus main body 1. A position of the toner supply container 50 on the front side is determined by the engagement of the supporting pin 67*d* and a recessed part 68*a* provided in a holder 68 attached to the toner supply container 50. That is, a positioning part for positioning the toner supply container 50 in the apparatus main body 1 is formed by the supporting pins 67*b*, 67*c* and 67*d* and the recessed parts 51*a*, 51*b* and 68*a*. A driving force is transferred by the driving couplings (recesses) 60*a* and 60*b* and the driving couplings (protrusions) 61*a* and 61*b*.

(Description of a State in Which a Developer is Consumed)

Situations in which toner in the toner containing portion 52 is consumed will now be described with reference to FIGS. 10 to 12. FIG. 10 illustrates a -state in which a toner containing portion 52 is sufficiently filled with toner, FIG. 11 illustrates a state in which the toner in the toner containing portion 52 decreases and FIG. 12 illustrates a state in which the toner in the toner containing portion 52 is running out.

As described above, the agitating plate 57 or the first feeding member is formed symmetrically around the receiving port 55*a* and generates a feeding force in an arc part on the bottom surface of the toner supply container 50, whereby toner in the toner containing portion 52 is fed in the direction of the receiving port (outlet of the containing chamber) 55*a* from the both sides of the toner containing portion 52. Then, when the toner containing portion 52 is sufficiently filled with toner T as shown in FIG. 10, in the position of the receiving port 55*a*, the toner T moves to the upper part where the feeding force is weak and circulates in the directions indicated by the arrows in FIG. 10.

On the other hand, the toner T existing in the receiving port 55*a* falls into the toner feeding portion 54 by free fall and is fed in the direction of the outlet (outlet of the containing chamber) 53*a* by the screw 58 or the second feeding member. Then, the toner T in the toner containing portion 52 is gradually discharged from the outlet 53*a* and consumed as shown in FIG. 11. At this point, the toner T is collected in the receiving port 55*a* while circulating as shown in FIG. 11. The part surrounding the receiving port 55*a* is filled with the toner T even while the toner T is being consumed. Thus, the amount of the toner T existing in the toner feeding portion 54 is the same as that existing there in the state in which the toner containing portion 52 is sufficiently filled with the toner T. In other words, since a toner feeding amount for one revolution of the first feeding member 57 is larger than a toner feeding amount for one revolution of the second feeding member 58, toner always exists in the receiving port 55*a*.

Finally, the toner T in the toner containing portion 52 is almost completely consumed. However, since the toner T in the toner containing portion 52 always continues to fill the part around the receiving port 55*a*, the amount of toner in the toner feeding portion 54 is constant from the initial period of using the toner supply container 50 to the time when the toner is almost completely consumed in the end. In this way, the amount of the toner T falling into the toner feeding portion 54 is always maintained constant. Thus, it becomes possible to manage the feeding amount of toner by managing the number of revolutions of the screw 58 or the second feeding member and, whereby it eventually becomes possible to always stabilize the amount of toner discharged from the outlet 53*a*.

As described above, stabilization of the amount of toner discharged from the outlet 53*a* of the toner supply container 50 can be attained by maintaining constant the toner amount in the toner feeding portion 54 fed by the screw 58 or the second feeding means by the receiving port 55*a* and the agitating plate 57 or the first feeding means.

In addition, the screw 58 for supplying toner to the developing device 15 is provided in the toner supply container 50. Thus, it is sufficient to dispose a sealing member for preventing leakage of the toner only between the outlet 53*a* of the toner supply container 50 and the supply port 25 of the developing device 15, and parts to be sealed can be restrained to the minimum required.

(Other Embodiments)

In the above-mentioned embodiment, the partition plate 55 is described as being formed of a sheet member of resin. However, a material of the partition plate 55 may be any material such as metal, paper and wood as long as it partitions the toner containing portion 52 and the toner feeding portion 54. In addition, the partition plate 55 may be integrally formed with the frame 51.

Figure 13:
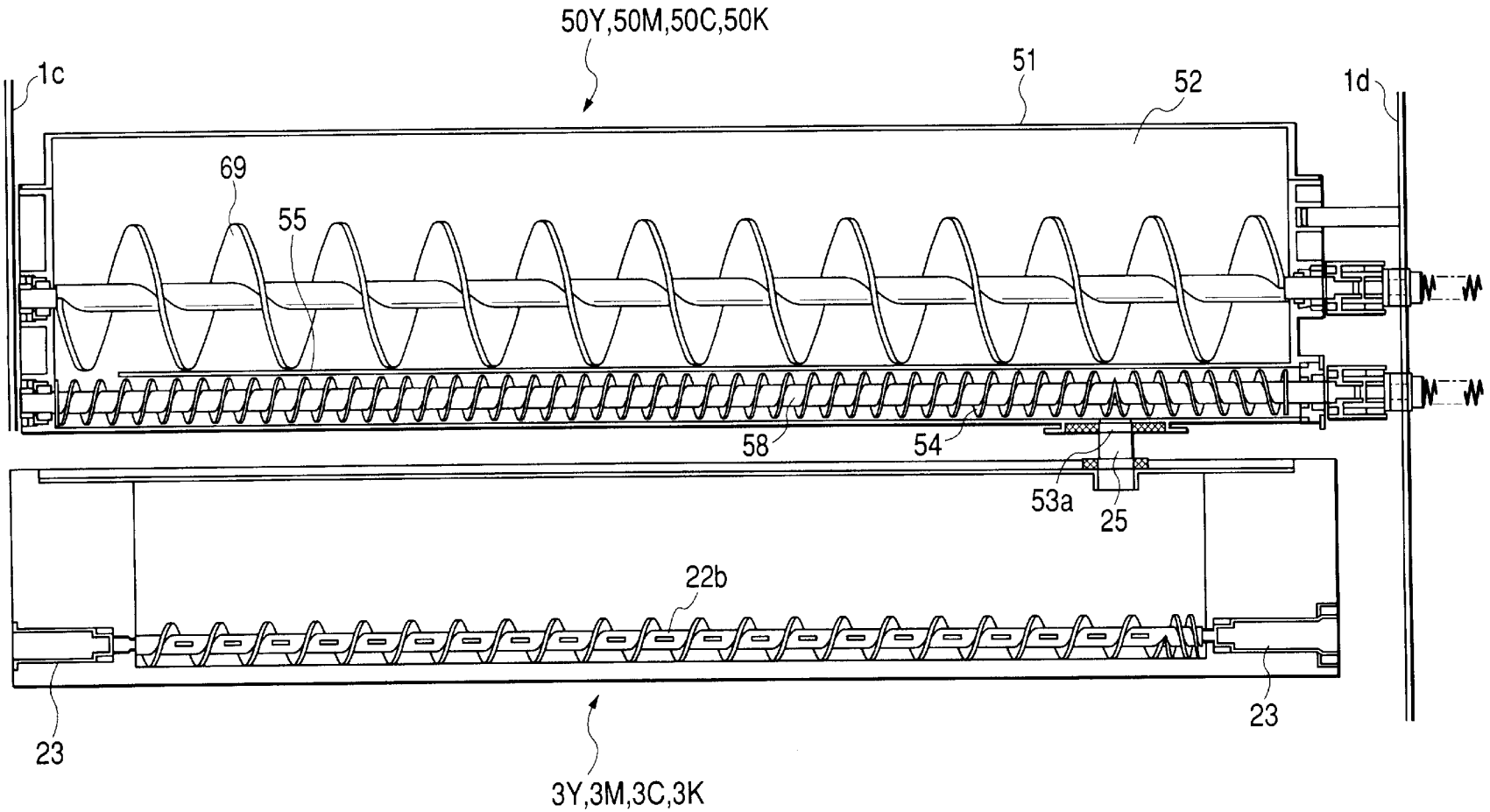
FIG. 13 is a longitudinal sectional view of a developer supply container in accordance with another embodiment.

In addition, in the above-mentioned embodiment, the agitating plate 57 or the first feeding member is described as being formed of a flexible sheet member that obtains a feeding force by being twisted. However, a material of the agitating plate 57 may be any material as long as it feeds the toner in the toner containing portion 52 in the direction of the receiving port 55*a*. For example, the feeding member 69 having a spiral rib shape (a so-called screw) as shown in FIG. 13, a coil or the like may be used. Moreover, the receiving port 55*a* is disposed substantially in the center of the toner containing portion 52. However, this disposition is for the purpose of reducing costs by shortening the screw 58 or the second feeding means, and the receiving port 55*a* may be disposed in the end part on the front side as shown in FIG. 13.

Further, the developer supply container in accordance with the present invention is not limited to the two-component development method, and can supply a developer in a process cartridge or a developing cartridge using a mono-component development method. In addition, powder to be contained in the developer supply container is not limited to toner, and a mixture of toner and a magnetic carrier, or a so-called two-component developer may be contained.

As many apparently widely different embodiments of the present invention can be made without departing from the spirit and scope thereof, it is to be understood that the invention is not limited to the specific embodiments thereof except as defined in the appended claims.

What is claimed is:

1. A developer supply container detachably mountable on an image forming apparatus, comprising:

a containing chamber for containing a developer;

a first feeding member, which is provided in said containing chamber and which feeds the developer to an outlet of said containing chamber;

a feeding chamber communicating with said containing chamber;

a second feeding member, which is provided in said feeding chamber and which feeds the developer coming from said containing chamber to an outlet of said developer supply container; and a partition member for partitioning said developer supply container into said containing chamber and said feeding chamber, wherein a partitioning area of said partition member is much larger than an area of said outlet of said containing chamber.

2. A developer supply container according to claim 1, wherein said first feeding member contacts an inner wall of said containing chamber.

3. A developer supply container according to claim 1, wherein a feeding amount of the developer per unit of time fed by said second feeding member is less than a feeding amount of the developer per unit of time fed by said first feeding member.

4. A developer supply container according to claim 1, wherein a volume of said feeding chamber is less than a volume of said containing chamber.

5. An image forming apparatus comprising:

developing means for developing a latent image formed on an image bearing member; and a developer supply container for supplying developer to said developing means, said developer supply container being detachably mountable to said image forming apparatus, wherein said developer supply container includes:

a containing chamber for containing the developer;

a first feeding member, which is provided in said containing chamber and which feeds the developer to an outlet of said containing chamber;

a feeding chamber communicating with said containing chamber;

a second feeding member, which is provided in said feeding chamber and which feeds the developer coming from said containing chamber to an outlet of said developer supply container; and a partition member for partitioning said developer supply container into said containing chamber and said feeding chamber, wherein a partitioning area of said partition member is much larger than an area of said outlet of said containing chamber.

6. An image forming apparatus according to claim 5, wherein said developing means is detachably mountable to said image forming apparatus.

7. An image forming apparatus according to claim 6, further comprising an image bearing member, wherein said image bearing member is detachably mountable to said image forming apparatus together with said developing means.

8. An image forming apparatus according to claim 7, further comprising a charging member for charging said image bearing member, wherein said charging member is detachably mountable to said image forming apparatus together with said developing means.

9. An image forming apparatus according to claim 5, wherein the developer supplied by said developer supply container to said developing means is toner.

10. An image forming apparatus according to claim 9, wherein said developing means contains a carrier and the toner supplied from said developer supply container, and said image forming apparatus further includes controlling means for controlling said second feeding member so that the toner contained in said developing means maintains a predetermined density.

11. An image forming apparatus according to claim 10, wherein said controlling means controls a number of revolutions of said second feeding member.

* * * * *

UNITED STATES PATENT AND TRADEMARK OFFICE

CERTIFICATE OF CORRECTION

PATENT NO. : 6,556,800 B2
DATED : April 23, 2003
INVENTOR(S) : Kenji Matsuda et al.

It is certified that error appears in the above-identified patent and that said Letters Patent is hereby corrected as shown below:

Title page,
Before ABSTRACT, please insert the following Item:
-- [74] *Attorney, Agent, or Firm*—Fitzpatrick, Cella, Harper & Scinto --.

Column 2,
Line 1, "supply" should read -- supplies --.

Column 10,
Line 56, "-toner" should read -- toner --.

Column 12,
Line 2, "id" should read -- 1d --; and
Line 41, "-state" should read -- state --.

Signed and Sealed this

Twenty-third Day of December, 2003

JAMES E. ROGAN
*Director of the United States Patent and Trademark Office*